United States Patent [19]

Olson

[11] 4,055,981

[45] Nov. 1, 1977

[54] PORTABLE GUARDRAIL STRAIGHTENER FOR FIELD USE

[76] Inventor: Barry W. Olson, 1361 E. Parkway Ave., Salt Lake City, Utah 84106

[21] Appl. No.: 760,491

[22] Filed: Jan. 19, 1977

[51] Int. Cl.[2] ..... B21D 13/02; B21D 37/14

[52] U.S. Cl. ..... 72/415; 72/475

[58] Field of Search ..... 72/385, 389, 412, 414, 72/415, 416, 470, 474, 475

[56] References Cited

U.S. PATENT DOCUMENTS

| | | | |
|---|---|---|---|
| 566,827 | 9/1896 | Wardwell | 72/416 |
| 2,788,831 | 4/1957 | Weiner | 72/415 |
| 2,822,854 | 2/1958 | Berg | 72/385 |
| 3,779,295 | 12/1973 | Balsbaugh | 72/475 |

*Primary Examiner*—C.W. Lanham
*Assistant Examiner*—Gene P. Crosby
*Attorney, Agent, or Firm*—Lynn G. Foster

[57] ABSTRACT

A portable guardrail straightener for field use whereby damaged guardrails along highways may be straightened without the necessity of removing and retrieving the guardrails to a shop site for repair, the portable guardrail straightener for field use comprising a mechanism to be mounted on a vehicle whereby the mechanism is transported from one field location to another, the mechanism further comprising a guardrail straightening jig comprising two matching dies the configuration of which conforms to the cross section of an undamaged guardrail, one die being mounted to a reciprocable carriage driven by a two-way cylinder between open and closed positions and the other die being mounted to a fixed frame such that once the dies are located horizontally juxtaposed a damaged section of guardrail and closed, the damaged guardrail will be cold deformed into substantially its initial longitudinal and cross-sectional configuration.

8 Claims, 3 Drawing Figures

PORTABLE GUARDRAIL STRAIGHTENER FOR FIELD USE

BACKGROUND

1. Field of the Invention

The present invention relates to the straightening of guardrails and more particularly to field straightening of guardrails using a novel portable guardrail straightener.

2. Prior Art

In the past, it has become customary to remove damaged guardrail sections from their locations along highways after which the damaged guardrail sections are brought to a shop, repaired, repainted, returned and re-installed or used elsewhere as replacement sections. This has resulted in considerable inefficiency in the form of expenditure of time and substantial costs.

BRIEF SUMMARY AND OBJECTS OF THE PRESENT INVENTION

The present invention comprises a novel portable guardrail straightener for field use comprising a mechanism adapted to be mounted to a vehicle for transporting the same from field location to field location. A mechanism comprises a jig mounted upon the vehicle such that the same may become aligned with a section of damaged guardrail while the guardrail is either retained in its installed position along the highway or removed and placed within the jig after which reciprocable jaws or dies of the jigs are closed under substantial pressure against the damaged guardrail section thereby returning or substantially returning the damaged guardrail section to its original cross sectional and longitudinal configuration.

Accordingly, it is a primary object of the present invention to provide a novel portable guardrail straightener for field use.

A further primary object of the present invention is the provision of a guardrail straightener which may be used to straighten guardrails in the field either with or without removing the guardrail sections from their mounted disposition adjacent the highway.

A further significant object of the present invention is the provision of a guardrail straightener for returning a damaged section of guardrail substantially to its initial cross sectional and longitudinal configuration without the requirement of removing the guardrail section in a shop site remote from the highway.

These and other objects and features of the present invention will be apparent from the following detailed description, taken with reference to the accompanying drawings.

DETAILED DESCRIPTION OF ILLUSTRATED EMBODIMENT

Figure 1:
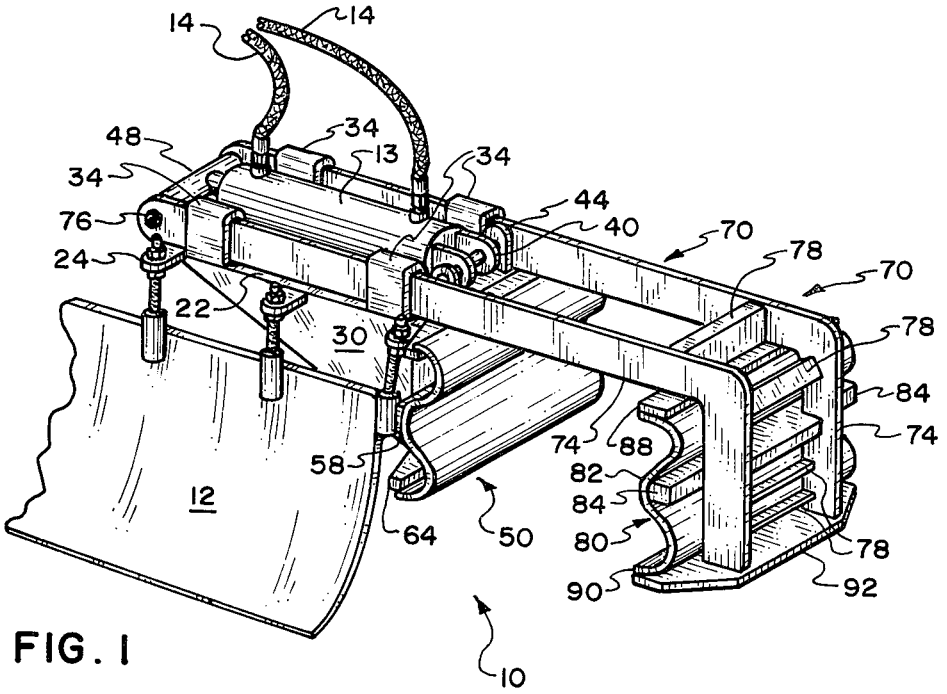
FIG. 1 is a perspective representation of a portable guardrail straightener for field use according to the present invention.
Figure 2:
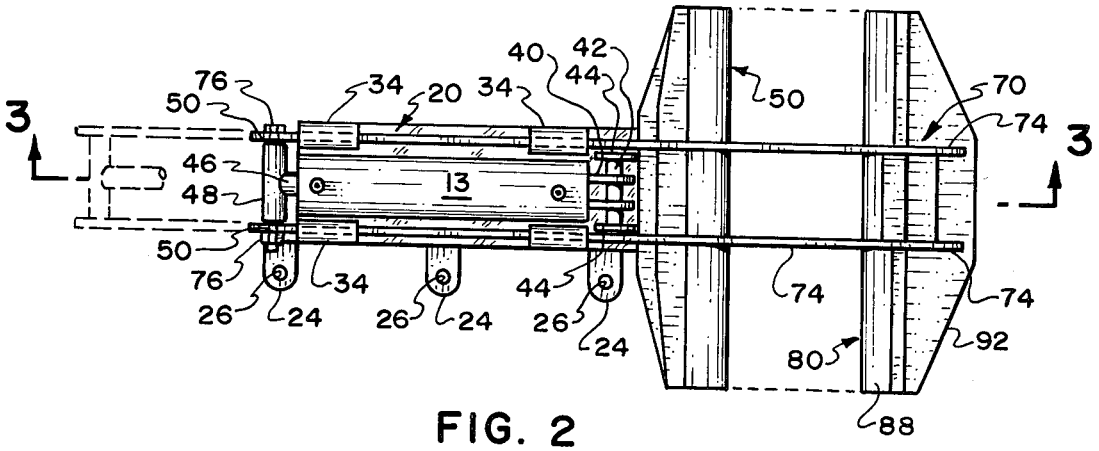
FIG. 2 is a plan view of the guardrail straightener of FIG. 1.

Reference is now made to the drawings wherein like numerals are used to designate like parts throughout and which illustrates a presently preferred guardrail straightener, generally designated 10, fabricated in accordance with the present invention. Guardrail straightener 10 is intended for field use preferably without removal of the damaged guardrail section from its mountings along a highway but will also serve to field straighten such sections when removed achieving onsite cold deformation of the damaged guardrail to substantially its initial cross sectional and longitudinal configuration. The guardrail straightener 10 is adapted to be mounted upon a vehicle (not entirely shown) of any one of several possible types. One suitable guardrail straightener contemplated is the utilization of a motor patrol or road grader having an adjustable blade and controls for variously relocating the blade, which comprises part of the vehicle, thereof. Such a blade is illustrated in FIG. 1 and designated by the numeral 12. Thus, by reorienting the blade 12 of the motor patrol vehicle, the guardrail straightener 10 is correspondingly relocated. As a result, the guardrail straightener may be suitably placed adjacent opposite sides of a damaged guardrail section. The vehicle, upon which the guardrail straightener 10 is to be mounted, will carry a suitable fluid pressure system fabricated in accordance with conventional practice whereby hydraulic or pneumatic fluid under substantial pressure is caused to be displaced to and from a fluid cylinder 13 through hoses 14 and fittings 16.

Figure 3:
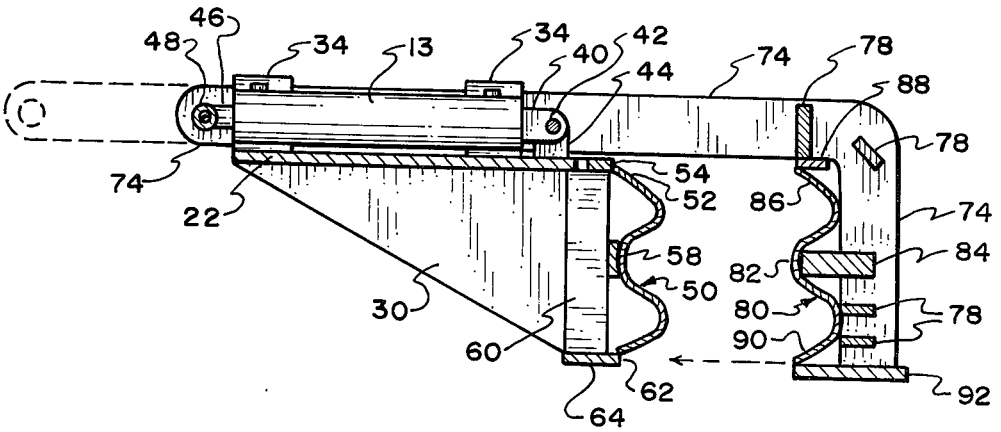
FIG. 3 is a longitudinal cross section taken along line 3—3 of FIG. 2 of the guardrail straightener of FIG. 1.

The guardrail straightener 10 comprises a rigid L-shaped frame, generally designated 20, which comprises a plate 22 from which anchor lugs 24 integrally project. Each anchor lug 24 comprises an aperture 26, which receives and retains a conventional clevis connector 28, either spring loaded or rigid, each clevis connector 28 bridging between weld sites at the top of the grader blade 12 and the anchor lugs 24 and thereby firmly mounting the frame 20 to the blade 12. In addition to the plate 22, the rigid frame 20 comprises a pair of triangular reinforcing plates 30 extending between the distal lug 24 and a stationary, vertically depending die plate 64, each triangular plate 30 being welded in the position illustrated in FIG. 3.

Adjacent each longitudinal edge of plate 22 is mounted at least two U-shaped guide brackets 34. Each guide bracket 34 is welded to the plate 22 and comprises a rectangular opening through which carriage arms (later to be hereinafter described) reciprocate. Preferably the interior of the brackets 34 are coated with a suitable lubricant, such as grease. Cylinder 13 is mounted to the top of plate 22 in a conventional fashion. More specifically, the mounting brackets 40, which are apertured and mounted to the proximal end of the cylinder 13 receive a crosspiece 42 which is welded or bolted to a pair of opposed upwardly directed lugs 44, while the piston rod 46 which extends outward of the distal end of the cylinder 13 carries at the distal end thereof a mounting crossbar 48 presenting a threaded short shaft 50 at each end, for purposes hereinafter more fully explained. At the proximal or trailing end of the plate 22 is mounted a first die 50 in vertical downwardly depending relation. Die 50 may comprise any material fabricated to correspond to the cross section and longitudinal configuration of the initial configuration of a guardrail to be straightened. In the illustrated embodiment, one or more (superimposed) guardrail sections comprise die 50. The top flange 52 of the die 50 is welded to a top die plate 22 and there rigidly secured by a reinforcing bar 54. The central concave portion 56 of the die 50 is reinforced and backed by a pair of plates 58 and 60 which are welded to the remainder of the fixed frame 22 so as to be rigid. The lower flange 62 is secured in the vertically depending illustrated position best shown in FIG. 3 by bottom die plate 64.

Thus, the rigid frame 20 rigidly supports the die plate 50.

The guardrail straightener 10 also comprises a carriage, generally designated 70. The carriage comprises two L-shaped arms 72 which are parallel one to the other and respectively project through two opposed pairs of guide brackets 34 for reciprocation by the cylinder 13. The crosspiece 48 of cylinder 13, which is mounted to the distal end of the piston rod 46, passes through apertures at the end of each long leg of the L-shaped arm 74 receiving the threaded end 50 and securing themselves by nuts 76. Apart from avoiding interference with cylinder 13, the two L-shaped arms 74 are anchored one to the other for unitary displacement by action of the cylinder 13 using a plurality of crosspieces welded therebetween, the crosspieces being designated collectively by the numeral 78. A second guardrail die 80 is welded in matching relationship to the die 50 on the inside of the short legs of the two L-shaped arms 74 in essentially a vertical depending relationship, the convexity 82 being supported by a transverse block 84 running the full length of the die 80 and being welded in position to the die. The top flange 86 of the die 80 is welded to the lower surface of the top crosspiece 82 and the bottom flange 90 is welded to the bottom crosspiece 92.

It is to be appreciated that the connection between the various parts of the rigid frame 20 and the carriage 70, respectively, are joined one to another by welding, although other suitable fastening techniques could be used.

From the foregoing, it should be readily appreciated that in use the opposed dies 50 and 80 are opened and placed on opposite sides of a damaged guardrail either with the guardrail remaining mounted adjacent the highway, or in the field with the guardrail section removed. The advantage of mounting the guardrail straightener 10 upon the blade 12 of a motor grader or the like is that the blade 12 or comparable mounting may be readily manipulated into horizontally aligned relationship with the damaged guardrail section, where the rail is retained in its mounted condition. Once proper horizontal alignment is obtained between the damaged guardrail section and the two die sections 50 and 80, the cylinder 13 is actuated in a conventional fashion by the operator whereby the piston rod 46 is caused to be extended thereby displacing the carriage 70 from right to left as viewed in FIG. 1 through the U-shaped guides 34, the dies 50 and 80 closing on and cold deforming the damaged guardrail section causing it to return or substantially return to its original cross sectional and longitudinal configuration. In the event that the guardrail is severely damaged over a protracted length thereof opening and closing of the dies 50 and 80 consecutively along the guardrail may be necessary in order that the guardrail may be adequately straightened.

Also, the present invention has utility in repositioning guardrail posts in the field whereby straight alignment of displaced posts and damaged guardrails may be achieved in the field.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A portable guardrail straightener for field use in highway maintenance comprising:

vehicle means a pressure-applying mechanism;

means mounting the pressure-applying mechanism to the vehicle means;

the pressure-applying mechanism comprising:

first frame means;

first die means comprising top and bottom edges and opposed ends, the cross sections configuration of the first die means substantially matching the original configuration of a damaged guardrail to be straightened the first die means being mounted adjacent one edge thereof to the first frame means for being positioned adjacent one side of said damaged guardrail in the field;

second frame means;

second die means comprising top and bottom edges and opposed ends, the cross sectional configuration of the second die means substantially matching the configuration of both the damaged guardrail and the first die means, the second die means being mounted adjacent one edge thereof to the second frame means for being positioned adjacent the other side of damaged guardrail the edges of said first and second die means remote from the edges adjacent the frame means opening for lateral damaged guardrail access;

pressure-applying power means relatively reciprocating the first and second die means between an open condition and a closed condition contiguous with the damaged guardrail thereby cold deforming the damaged guardrail substantially into its original cross sectional and longitudinal configuration.

2. A portable guardrail straightener according to claim 1 wherein the second frame means comprises a reciprocable carriage.

3. A portable guardrail straightener according to claim 1 wherein both die means are rigidly secured adjacent the upper edge thereof to their respective frame means in vertically depending relation.

4. A portable guardrail straightener according to claim 1 wherein said pressure-applying power means comprise at least one fluid cylinder interposed between the first and second frame means for reciprocating the dies between said open and closed conditions.

5. A portable guardrail straightener as defined in claim 1 wherein the pressure-applying mechanism is selectively elevated and lowered when open laterally into and out of alignement with said damaged guardrail without removing the guardrail from its installed position.

6. A portable guardrail straightener according to claim 1 wherein the first frame means comprises a static frame.

7. A portable guardrail straightener according to claim 6 wherein said first die means is rigidly secured in vertical depending relation to the static frame.

8. A portable guardrail straightener for field use in highway maintenance comprising a pressure-applying mechanism, the pressure-applying mechanism comprising:

first frame means;

first die means comprising top and bottom edges and opposed ends, the cross sectional configuration of the first die means substantially matching the configuration of a damaged guardrail to be straightened and carried adjacent one edge of the first die means by the first frame means for positioning adjacent one side of said guardrail in the field;

second frame means;

second die means comprising top and bottom edges and opposed ends, the cross sectional configuration of the second die means substantially matching the configuration of the guardrail section and the first die means, the second die means being carried adjacent one edge of the second die means for being positioned adjacent the other side of said damaged guardrail, the edges of said two die means remote from said frame means together defining an opening for lateral damaged guardrail access;

pressure-applying power means relatively reciprocating the first and second die means between an open condition and a closed condition contiguous with the damaged guardrail thereby cold deforming the damaged guardrail substantially into its original cross sectional and longitudinal configuration.

* * * * *